United States Patent [19]

Nielsen

[11] Patent Number: 4,583,347

[45] Date of Patent: Apr. 22, 1986

[54] VACUUM PACKAGING APPARATUS AND PROCESS

[75] Inventor: Broder Nielsen, Hagenkamp, Fed. Rep. of Germany

[73] Assignee: W. R. Grace & Co., Cryovac Div., Duncan, S.C.

[21] Appl. No.: 743,871

[22] Filed: Jun. 11, 1985

Related U.S. Application Data

[63] Continuation of Ser. No. 433,600, Oct. 7, 1982, abandoned.

[51] Int. Cl.[4] ..... B65B 31/02

[52] U.S. Cl. ..... 53/434; 53/512

[58] Field of Search ..... 53/433, 434, 511, 512

[56] References Cited

U.S. PATENT DOCUMENTS

| | | | |
|---|---|---|---|
| 3,714,754 | 2/1973 | Holcombe et al. | 53/84 X |
| 3,832,824 | 9/1974 | Burrell | 53/417 |
| 3,965,646 | 6/1976 | Hawkins | 53/512 |
| 4,132,048 | 1/1979 | Day | 53/512 |
| 4,164,111 | 8/1979 | Di Bernardo | 53/512 |
| 4,182,095 | 1/1980 | Day | 53/512 |
| 4,457,122 | 7/1984 | Atkins et al. | 53/434 |

FOREIGN PATENT DOCUMENTS

| | | | |
|---|---|---|---|
| 2078658 | 1/1982 | United Kingdom | 53/434 |

*Primary Examiner*—John Sipos
*Assistant Examiner*—Donald R. Studebaker
*Attorney, Agent, or Firm*—John J. Toney; William D. Lee, Jr.; Mark B. Quatt

[57] ABSTRACT

A vacuum packaging process and apparatus employ the novel step of deliberately at least partially repressurizing the exterior of a flexible packaging receptacle after commencement of the evacuation of the exterior and interior of the receptacle in a chamber. The receptacle is closed after the receptacle has been pressed against the article located in the receptacle by repressurization.

1 Claim, 2 Drawing Figures

VACUUM PACKAGING APPARATUS AND PROCESS

This application is a continuation of application Ser. No. 433,600 filed on Oct. 7, 1982, now abandoned.

BACKGROUND OF THE INVENTION

The present invention relates to a process of and an apparatus for packaging an article in a receptacle to obtain a vacuum pack.

Hitherto it has been known to package an article in a plastics envelope, such as a plastic bag, by loading the article in the envelope and then inserting the loaded envelope into a vacuum chamber for the atmosphere around the envelope to be reduced in pressure so that the air or other gas within the envelope is extracted and finally the envelope can be sealed under low pressure conditions. The resulting package is termed a "vacuum package".

It is also known for the operation of the process to be such that during the reduction in pressure of the atmosphere around the envelope, the wall of the envelope baloons away from the enclosed article, so that the extraction of air from within the envelope can be more effectively carried out. Such a system has, for example, been disclosed in U.S. Pat. No. 3,714,754 (Holcombe) using a nozzle to extract air from within the envelope while the pressure of the atmosphere around the envelope has reduced to effect the necessary ballooning action. Ballooning has furthermore been disclosed in U.S. Pat. No. 3,832,824 (Burrell) in which the vacuum chamber in which the envelope is closed has two portions of which a first portion encloses the envelope mouth and the second portion encloses the article-enclosing remainder of the envelope so that the pressure around the exterior of the envelope can initially be reduced more rapidly than the pressure within the envelope (in order to promote the desired ballooning effect). Such a process is suitable for a high vacuum pack when a long evacuation step can be tolerated. Furthermore, sealing the pack while it is in a ballooned condition will give rise to uncertainty of the volume of residual air still in the pack at the time of sealing, leading to uncertainty of the air pressure within the sealed bag when the pack exterior is returned to atmospheric pressure outside the chamber.

When using such process for packing products having a porous structure the high vacuum applied can remove air out of the product so that the structure of the product will be destroyed or at least damaged.

SUMMARY OF THE INVENTION

It is an object of the present invention to provide an improved method and apparatus for packaging articles in a receptacle so as to overcome the disadvantages of the prior art.

Accordingly, the present invention provides a process of vacuum packaging an article in a flexible receptacle, comprising the steps of (a) loading the article in the receptacle (b) extracting gas from around the exterior of the receptacle to lower the surrounding pressure and extracting gas from within the receptacle, (c) raising the pressure surrounding the receptacle in a pressure restoration phase after such pressure has been initially lowered, which pressure restoration phase is started at a predetermined pressure difference between the pressure surrounding the receptacle and the pressure within the receptacle, and (d) closing the receptacle in a gas-tight manner immediately after the receptacle has been pressed against the exterior of the article by said raising of the pressure surrounding the receptacle.

By raising the pressure around the receptacle after an initial lowering of pressure the flexible receptacle will be pressed against the product so that gas located between the outer surface of the article and the receptacle will be pressed out of the receptacle. Thereafter the receptacle will be closed. Since such way of pressing gas out of the receptacle does not require a high vacuum the structure of the article will not be damaged and a "soft vacuum" pack is obtained.

The present invention also provides apparatus for vacuum packaging, comprising a vacuum chamber having an extraction pump for extracting gas from within the interior of the chamber and a support for a loaded receptacle to be evacuated and sealed in the chamber; means for restoring pressure to the exterior of a receptacle disposed within the vacuum chamber after partial evacuation of the chamber by the extraction pump; and means for closing a receptacle in the chamber.

DETAILED DESCRIPTION OF THE PREFERRED EMBODIMENT

Figure 1:
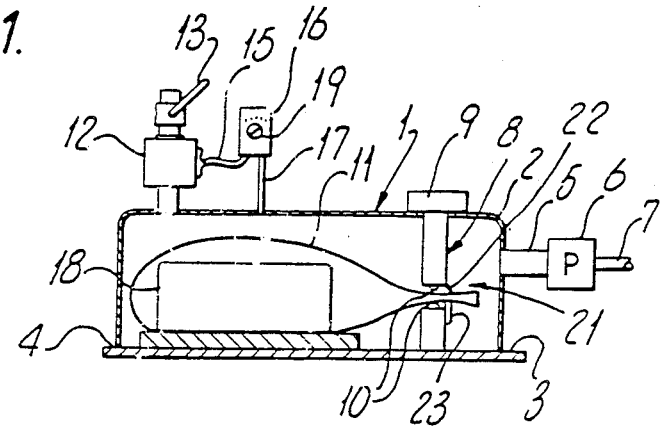
FIG. 1 is a schematic side elevational view of an embodiment of a vacuum packaging apparatus in accordance with the present invention.

The vacuum chamber 1 shown in FIG. 1 is of a conventional form and includes a vacuum enclosure comprising a cover 2 on a base 3 to which the cover is sealed along its rim 4. An air extraction duct 5 leads to an extraction pump 6 whose discharge duct 7 conveys away air which has been extracted from the chamber 1.

The chamber further includes a receptacle-closing unit 8 having a driven mechanism 9, here comprising a pair of opposed hot weld bars 10 which are driven towards one another to contact the neck region of the receptacle 11 (in this case a plastic bag of heat shrinkable thermoplastic material) and are energized with a pulse of electric energy to heat seal the neck region of the envelope before the chamber 1 opens. This closing unit is also associated with an optional yieldable bag holding means 21, here shown as a resilient blade 22 clamped along one edge (in this case the upper edge) and having its opposite, free edge (in this case the lower edge) disposed nearer to the bag mouth and nearer to an opposed anvil 23.

The embodiment of the present invention provides for the incorporation of an air admission valve 12 on the chamber cover 2 to admit air into the chamber while the extraction pump 6 is in operation. This unexpected modification has the surprising advantage of being able to allow more effective extraction of air from within the receptacle 11 provided the air admission value is operated in accordance with the process of the present invention.

The air admission valve 12 includes an airflow regulator lever 13 and is connected, by pneumatic control line 15, to a pneumatic control unit 16 which provides signal pulses to the valve 12 in response to the vacuum level in the chamber 1 as sensed by way of a sensing conduit 17. It is expected that the rate of admission of air through the valve 12 will be greater than the rate of extraction by the pump 6.

The control unit 16 for the air admission valve 12 includes a selector control 19 allowing adjustment of the particular valve of the residual pressure within the chamber 1 and therefore of the pressure difference between the interior and the exterior of receptacle 11 at which the valve 12 is opened and closed.

To perform the process in accordance with the invention, the chamber cover 2 is closed over the open receptacle 11 with article 18 therein, and the extraction pump 6 is energized to begin extraction of air from within the chamber 1 and consequently from within the receptacel 11 (by virtue of the neck region being yieldable held by the holding means 21 in the region adjacent the two spaced welding bars 10 of the closing mechanism 8).

Ideally the welding bars 10 are, during extraction, speced apart such that air is extracted at a controlled rate from within the receptacel 11 as the blade 22 yields, and this rate of extraction is less than the rate of pressure decrease in the atmosphere within the chamber 1 but around the exterior of the receptacle 11, with the result that the receptacle 11 balloons outwardly away from the article 18.

According to the invention, the air admission valve 12 should then be opened in order to vent air into the end of the chamber 1 where the article-enclosing part of the bag is located (preferably by simply opening the chamber 1 directly to atmosphere to allow atmospheric air to mix with the residual atmosphere around the exterior of the receptacle 11). Where the receptacle has already ballooned away from the article, this venting has the result that the receptacle 11 is pressed inwardly against the exterior of the article 18.

During this gas pressure restoration phase, the extraction of air from within the receptacle 11 will continue and in the case of a flexible bag 11 the thrusting of the flexible bag material 11 onto the product article will press air out of the bag 11. Pump 6 is maintained in operation even during the gas pressure restoration phase.

Where a yieldable bag holding means 21 is included, the blade 22 will remain in its "yielded" position (due to its elastic nature and its particular inclination) while air is being expelled from within the bag but will close off the bag neck when air pressure outside the bag neck region has risen to a value which impedes air venting from the bag.

After the receptacle 11 has been pressed against the exterior of article 18 and the air located between the receptacle and the exterior of the article has been pressed out of the neck of the receptacle, the receptacle 11 is closed by operation of the closing means 8 when its actuating means 9 are energized.

Figure 2:
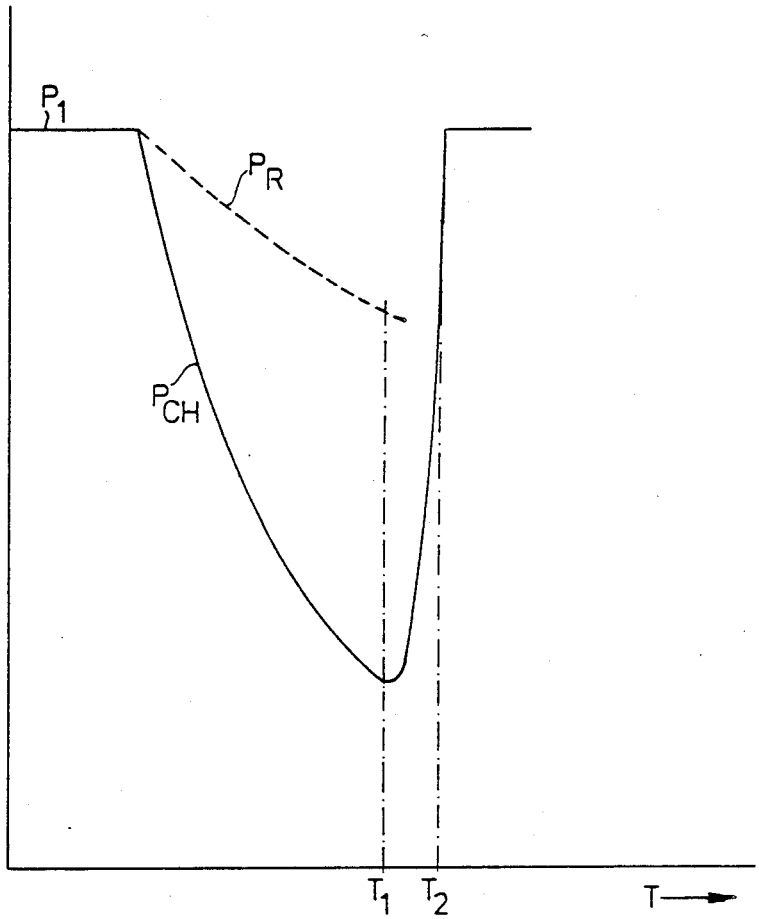
FIG. 2 is a cycle diagram of a process in accordance with the invention.

The apparatus of FIG. 1 is operated according to the process shown in the cycle diagram of FIG. 2.

At the start of such process the pressure within the chamber is at a value $P_1$, normally the atmospheric pressure in the packaging room. The machine is then set up as described in connection with FIG. 1 and the pressure $P_{CH}$ in the chamber is reduced which also results in a reduction of pressure $P_R$ in the receptacle. In the process in accordance with the invention, it is not important to reach a predetermined value of pressure $P_{CH}$ but a sufficient pressure difference between the pressure $P_{CH}$ and the pressure $P_R$.

If a sufficient pressure difference has been generated, e.g. a pressure difference of about 150 mb for a plastic bag as usually used for producing such packings, then the chamber 1 will be vented by opening the air admission valve 12. In the operating cycle depicted in FIG. 2 this occurs at the time $T_1$ and the pressure $P_{CH}$ in chamber 1 will increase rapidly upto $P_1$, whereas there will be no increase or almost no increase of pressure $P_R$ in the receptacle. By such increase of pressure $P_{CH}$ the flexible receptacle 11 is pressed inwardly against the exterior of the article 18 and the air located between the receptacle and the exterior of the article is pressed out of the neck of the receptacle 11. Preferably, the extraction pump 6 is kept in operation during venting of chamber 1.

In the process described generation of a high vacuum is avoided and the vacuum applied shall not be larger than required to obtain the necessary pressure difference between pressure $P_{CH}$ and pressure $P_R$. Therefore, removal of air from the interior of article 18 is minimized whereas the air located between the exterior of article 18 and receptacle 11 is effectively removed.

As it is preferred to suddenly press inwardly the receptacle 11 against the exterior of the article 18 to remove the air located between the receptacle 11 and the exterior of the article 18. Therefore the apparatus shown in FIG. 1 should be vented in such a way that increase of pressure $P_{CH}$ is obtained within the shortest time possible, i.e. the pressure curve $P_{CH}$ shown in FIG. 2 shall have a very high steepness starting at $T_1$.

Immediately after the receptacle 11 has been pressed against the exterior of the article 18 which step has been completed at time $T_2$ in the operation cycle depicted in FIG. 1, the receptacle 11 will be closed by means of the receptacle-closing means 8. Such closing will take place not later than 0.5 seconds after the time $T_2$ of FIG. 2 since otherwise air from chamber 1 might enter the neck portion of receptacle 11.

What is claimed:

1. A process for vacuum packaging an article in a flexible receptacle comprising:

(a) loading the article in the receptacle and placing the loaded, unsealed receptacle in a vacuum chamber having a single chamber;

(b) closing the chamber and extracting gas at a substantially constant rate therefrom to lower the pressure surrounding the receptacle thereby causing the receptacle to balloon away from the receptacle while also extracting gas from the unsealed receptacle;

(c) continuing the extraction of gas at a constant rate from the chamber while admitting gas to the chamber to raise the pressure surrounding the receptacle in a pressure restoration phase after the pressure has been initially lowered, said pressure restoration phase beginning at a predetermined pressure difference between the pressure surrounding the receptacle and the pressure within the receptacle;

(d) subsequently, increasing the rate of admitting gas to the chamber to a rate greater than the constant continuing rate of extraction thereby causing the receptacle to collapse around the article; and, (e) sealing said receptacle as the receptacle collapses upon the article.

* * * * *